US009055639B2

(12) United States Patent
Chu et al.

(10) Patent No.: US 9,055,639 B2
(45) Date of Patent: Jun. 9, 2015

(54) APPARATUS FOR DRIVING A PLURALITY OF SEGMENTS OF LED-BASED LIGHTING UNITS

(75) Inventors: Hung-Chi Chu, Kaohsiung (TW); Yuh-Ren Shen, Tainan (TW)

(73) Assignee: VastView Technology Inc., Hsinchu County (TW)

( * ) Notice: Subject to any disclaimer, the term of this patent is extended or adjusted under 35 U.S.C. 154(b) by 304 days.

(21) Appl. No.: 13/590,375

(22) Filed: Aug. 21, 2012

(65) Prior Publication Data

US 2014/0055050 A1 Feb. 27, 2014

(51) Int. Cl.
*H05B 41/00* (2006.01)
*H05B 33/08* (2006.01)

(52) U.S. Cl.
CPC ..... *H05B 33/0824* (2013.01); *H05B 33/0851* (2013.01); *H05B 33/0827* (2013.01); *H05B 33/0815* (2013.01); *H05B 33/083* (2013.01)

(58) Field of Classification Search
CPC ..... H05B 33/0815; H05B 33/083; H05B 33/0827; H05B 33/0824; H05B 33/0851
USPC ..... 315/291, 247, 294, 185 R, 307, 312, 315/185 S, 186, 192, 152, 158, 200 R, 315/209 SC, 309, 118, 149, 224, 225, 250, 315/297, 302, 308, 325, 349, 35, 354, 51, 315/193; 345/102, 204, 211, 82, 46, 98, 345/212
See application file for complete search history.

(56) References Cited

U.S. PATENT DOCUMENTS

| | | | | |
|---|---|---|---|---|
| 6,777,891 | B2 | 8/2004 | Lys et al. | |
| 6,989,807 | B2 | 1/2006 | Chiang | |
| 7,781,979 | B2 | 8/2010 | Lys | |
| 7,986,107 | B2 * | 7/2011 | Weaver et al. | 315/291 |
| 8,471,495 | B2 * | 6/2013 | Muguruma et al. | 315/299 |
| 2005/0243022 | A1 * | 11/2005 | Negru | 345/46 |
| 2007/0205977 | A1 * | 9/2007 | Kim | 345/102 |
| 2007/0257623 | A1 * | 11/2007 | Johnson et al. | 315/193 |
| 2008/0068298 | A1 | 3/2008 | Shen et al. | |
| 2010/0308739 | A1 | 12/2010 | Shteynberg et al. | |

* cited by examiner

*Primary Examiner* — Douglas W Owens
*Assistant Examiner* — Borna Alaeddini
(74) *Attorney, Agent, or Firm* — Lin & Associates IP, Inc.

(57) ABSTRACT

An LED-based lighting apparatus includes a plurality of LED-based lighting segments connected in series with a current control device. Each lighting segment has at least one LED-based lighting unit connected in series. A plurality of switch controllers controlled by a switching voltage comparator unit is connected with the plurality of LED-based lighting segments to provide multiple operation modes for turning on different number of LED-based lighting segments. In one embodiment, each switch controller is connected in parallel with a corresponding segment. The switching voltage comparator unit generates a propagation signal that propagates through and controls the plurality of switch controllers. In the other embodiment, each switch controller is connected between a positive end of the corresponding segment and a current control device. The switching voltage comparator unit generates two propagation signals that propagate through and control the plurality of switch controllers.

13 Claims, 12 Drawing Sheets

APPARATUS FOR DRIVING A PLURALITY OF SEGMENTS OF LED-BASED LIGHTING UNITS

BACKGROUND OF THE INVENTION

1. Field of the Invention

The present invention relates generally to LED-based lighting apparatuses, and more particularly to an apparatus for driving a plurality of LED-based lighting segments in an LED-based lighting apparatus.

2. Description of Related Arts

Light emitting diodes (LEDs) are semiconductor-based light sources often employed in low-power instrumentation and appliance applications for indication purposes. The application of LEDs in various lighting units has become more and more popular. For example, high brightness LEDs have been widely used for traffic lights, vehicle indicating lights, and braking lights.

An LED has an I-V characteristic curve similar to an ordinary diode. When the voltage applied to the LED is less than a forward voltage, only very small current flows through the LED. When the voltage exceeds the forward voltage, the current increases sharply. The output luminous intensity of an LED light is approximately proportional to the LED current for most operating values of the LED current except for the high current value. A typical driving device for an LED light is designed to provide a constant current for stabilizing light emitted from the LED and extending the life of the LED.

In order to increase the brightness of an LED light, a number of LEDs are usually connected in series to form an LED-based lighting unit and a number of LED-based lighting units may further be connected in series to form a lighting apparatus. For example, U.S. Pat. No. 6,777,891 discloses a plurality of LED-based lighting units as a computer-controllable light string with each lighting unit forming an individually-controllable node of the light string.

The operating voltage required by each lighting unit typically is related to the forward voltage of the LEDs in each lighting unit, how many LEDs are employed for each of the lighting unit and how they are interconnected, and how the respective lighting units are organized to receive power from a power source. Accordingly, in many applications, some type of voltage conversion device is required in order to provide a generally lower operating voltage to one or more LED-based lighting units from more commonly available higher power supply voltages. The need of a voltage conversion device reduces the efficiency, costs more and also makes it difficult to miniaturize an LED-based lighting device.

U.S. Pat. No. 7,781,979 provides an apparatus for controlling series-connected LEDs. Two or more LEDs are connected in series. A series current flows through the LEDs when an operating voltage is applied. One or more controllable current paths are connected in parallel with at least an LED for partially diverting the series current around the LED. The apparatus permits the use of operating voltages such as 120V AC or 240V AC without requiring a voltage conversion device. US Pat. Publication No. 2010/0308739 discloses a plurality of LEDs coupled in series to form a plurality of segments of LEDs and a plurality of switches coupled to the plurality of segments of LEDs to switch a selected segment into or out of a series LED current path in response to a control signal.

As more and more LED-based lighting units are used in high brightness lighting equipment, there is a strong need to design methods and apparatus that can drive and connect the LED-based lighting units intelligently and efficiently to increase the utilization of the LEDs and provide stable and high brightness by using the readily available AC source from a wall power unit. In addition, it is also highly desirable to provide many different operating modes for the connected LED-based lighting units so that the brightness can be controlled properly according to different lighting requirements or the variation of the voltage level of the AC source.

SUMMARY OF THE INVENTION

The present invention has been made to provide an apparatus that can efficiently drive an LED-based lighting apparatus to provide multiple operating modes according to the voltage level of an input AC voltage source. In accordance with the present invention, the LED-based lighting apparatus is divided into a plurality of LED-based lighting segments with each segment comprising a plurality of LED-based lighting units. The plurality of LED-based lighting segments are connected in series and the last segment is connected through a current control device to ground.

A primary object of the present invention is to provide an apparatus that can selectively turn on some or all the plurality of LED-based lighting segments as the input voltage level increases, and turn off some or all the LED-based lighting segments as the input voltage level decreases so as to provide multiple operating modes for the LED-based lighting apparatus.

Accordingly, in a first preferred embodiment, the apparatus of the present invention comprises a plurality of switch controllers controlled by a switching voltage comparator unit. Each switch controller is connected in parallel with one of the plurality of LED-based lighting segments. The switching voltage comparator unit sends a few common signals to the plurality of switch controllers based on the voltage level of the input voltage to reset the switch controllers, synchronize the switching of the switch controllers and signal whether the input voltage level is going up or down.

In the first preferred embodiment of the present invention, in addition to receiving the common signals from the switching voltage comparator unit, each switch controller further has an input for receiving an input propagation signal and an output for sending out an output propagation signal.

A first propagation signal is generated from the switching voltage comparator unit, sent to the first switch controller, and propagated through the plurality of switch controllers to the last switch controller so that the plurality of LED-based lighting segments can be selectively turned on as the voltage level of the input AC voltage increases and turned off as the voltage level of the input AC voltage reaches a maximum level and decreases.

In a second preferred embodiment of the present invention, the apparatus of the present invention also comprises a plurality of switch controllers controlled by a switching voltage comparator unit. Each LED-based lighting segment has a positive end connected in series with a negative end of a preceding segment. Each switch controller is connected between the positive end of one of the plurality of LED-based lighting segments and one end of the current control device.

In the second preferred embodiment, each switch controller also receives the common signals from the switching voltage comparator unit similar to the first embodiment. However, each switch controller sends an output propagation signal to both preceding and following switch controllers and has two inputs for receiving an input propagation signal sent from the preceding switch controller and an input propagation signal sent from the following switch controller.

Similar to the first embodiment, a first propagation signal is generated from the switching voltage comparator unit, sent to the first switch controller, and propagated through the plurality of switch controllers to the last switch controller. In addition, a last propagation signal is generated from the switching voltage comparator unit, sent to the last switch controller, and propagated backward through the plurality of switch controllers to the first switch controller.

In the second preferred embodiment, the plurality of LED-based lighting segments can also be turned on sequentially as the voltage level of the input AC voltage increases and turned off sequentially as the voltage level of the input AC voltage reaches the maximum level and decreases.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
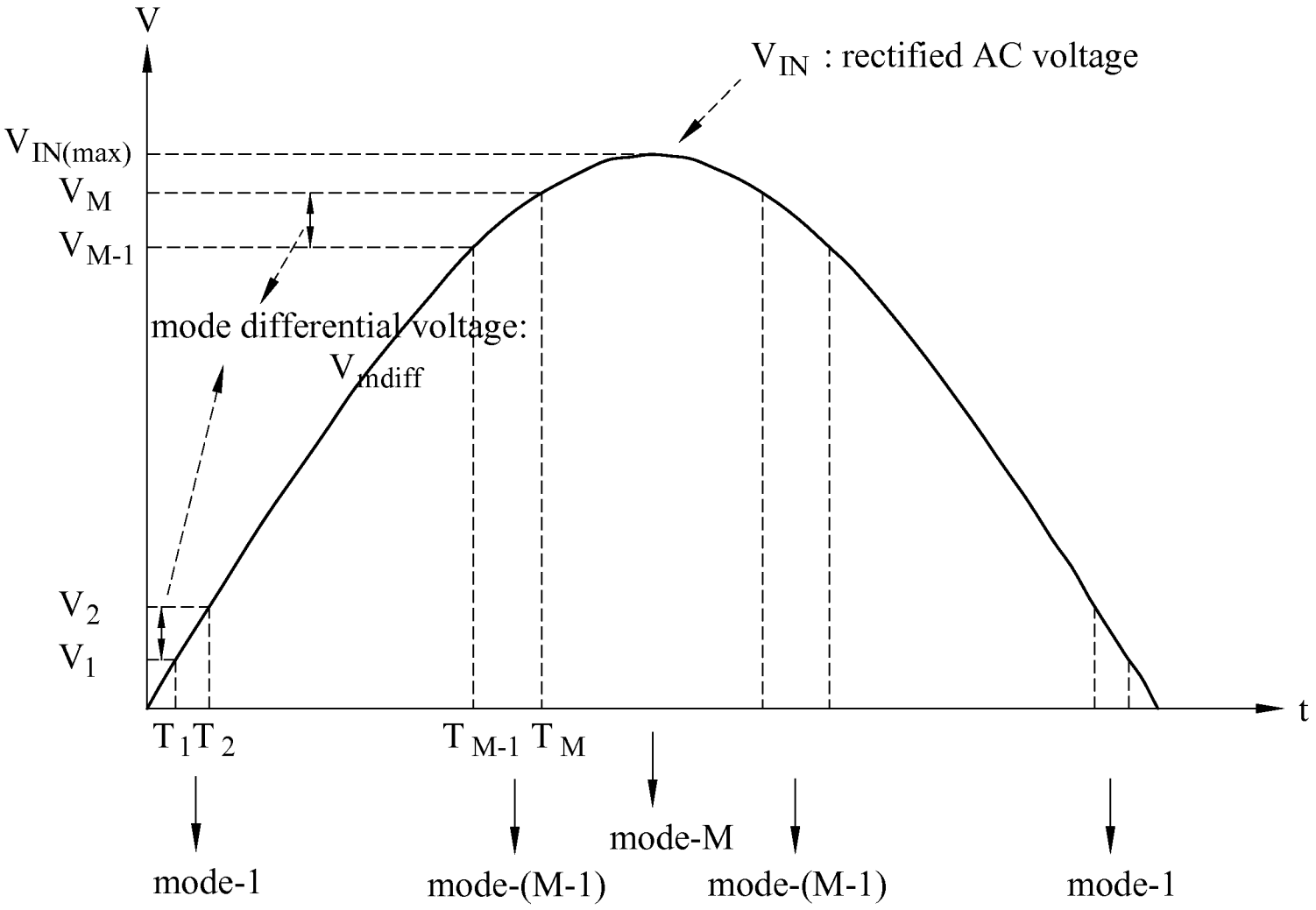
FIG. 1 shows the voltage levels of input voltage $V_{IN}$ for operating an LED-based lighting apparatus in M different operation modes using a rectified AC voltage source according to the present invention.

The accompanying drawings are included to provide a further understanding of the invention, and are incorporated in and constitute a part of this specification. The drawing illustrates embodiments of the invention and, together with the description, serves to explain the principles of the invention.

As mentioned above, in order to increase the brightness of an LED-based lighting apparatus, a number of LED lighting units each having one or more LEDs are usually connected in series to generate more luminous intensity. It is desirable to provide the LED-based lighting apparatus with multiple lighting modes for working with a rectified AC as the input voltage source. A straightforward approach is using a switching device for each LED-based lighting unit so that the LED-based lighting unit can be bypassed or serially connected. However, this approach is not practical because it requires very high hardware cost.

According to the present invention, a novel apparatus is provided for controlling the LED-based lighting apparatus segment by segment. The novel method divides the LED-based lighting units into a plurality of segments. Each segment forms an LED-based lighting segment comprising one or more LED-based lighting units connected in series. In each lighting mode, a number of LED-based lighting segments can be turned on and connected in series and some other segments bypassed. For simplicity, the following description assumes that each LED-based lighting unit has only one LED.

FIG. 1 shows the voltage levels of the input voltage $V_{IN}$ for operating an LED-based lighting apparatus in M different operation modes according to the present invention. $V_{IN}$ is a rectified AC voltage and each mode has a different number of LED-based lighting units connected in series. As shown in FIG. 1, the LED-based lighting apparatus operates in Mode-i between time $T_i$ and $T_{i+1}$ as the voltage level of the input voltage $V_{IN}$ increases between $V_i$ and $V_{i+1}$. As the rectified AC voltage reaches the maximum level, i.e., $V_{In(max)}$, the voltage level starts decreasing. The LED-based lighting apparatus operates in Mode-M while the voltage level is between $V_M$ and $V_{In(max)}$, and switches to operate in Mode-i when the voltage drops between $V_i$ and $V_{i+1}$. The difference between voltage $V_i$ and $V_{i+1}$ is the mode differential voltage $V_{mdiff}$.

Figure 2:
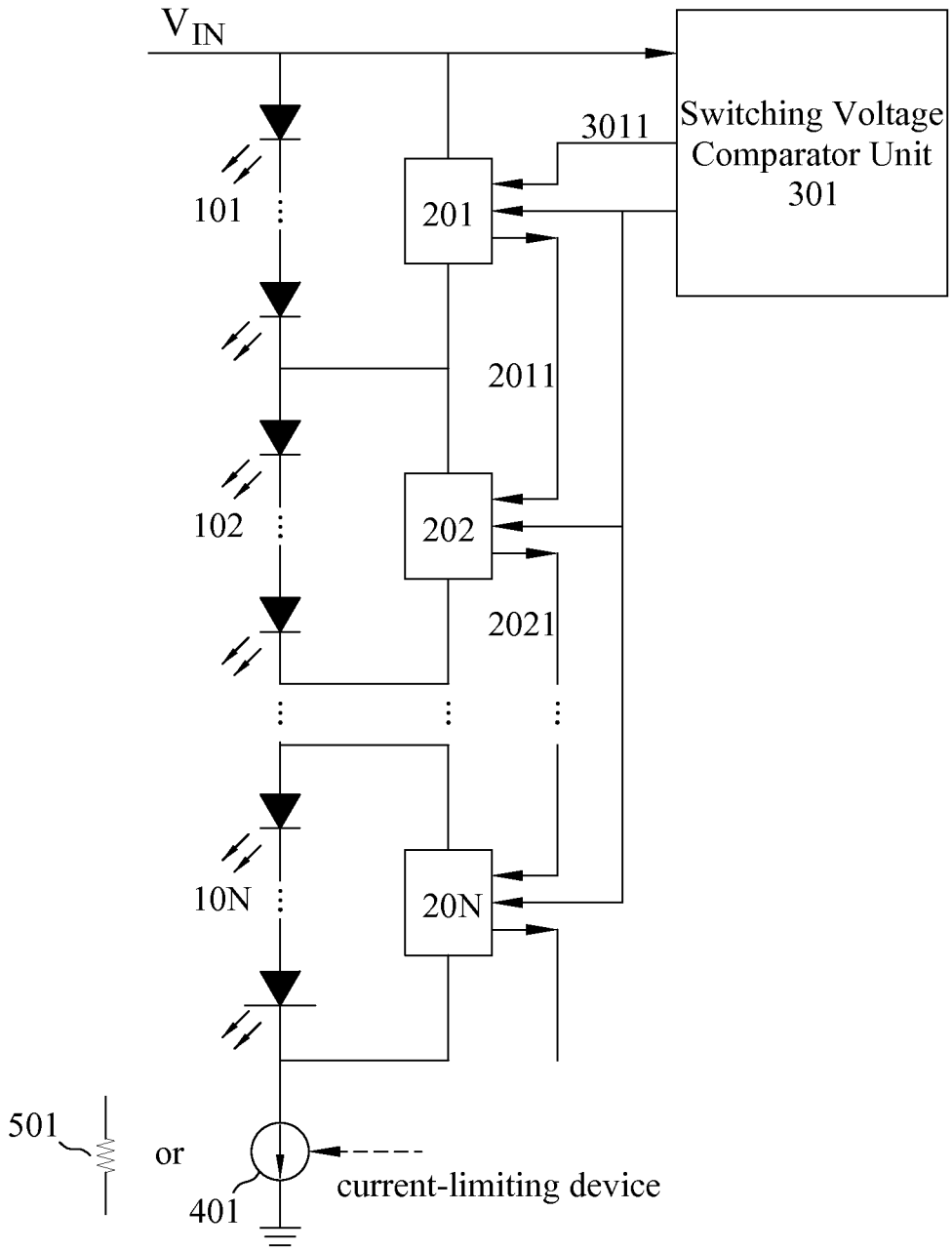
FIG. 2 shows the block diagram of the apparatus for driving a plurality of segments of LED-based lighting units according to a first preferred embodiment of the present invention.

FIG. 2 shows the block diagram of the apparatus for driving a plurality of segments of LED-based lighting units according to a first preferred embodiment of the present invention. In the embodiment, the LED-based lighting apparatus comprises a plurality of LED-based lighting segments 101, 102, . . . , 10N connected in series with a current control device 401 between the input voltage $V_{IN}$ and ground. Each LED-based lighting segment has a positive end and a negative end. A switch controller is connected in parallel with each LED-based lighting segment between the positive end and the negative end, and a switching voltage comparator unit 301 controls the plurality of switch controllers 201, 202, . . . , 20N.

Figure 3:
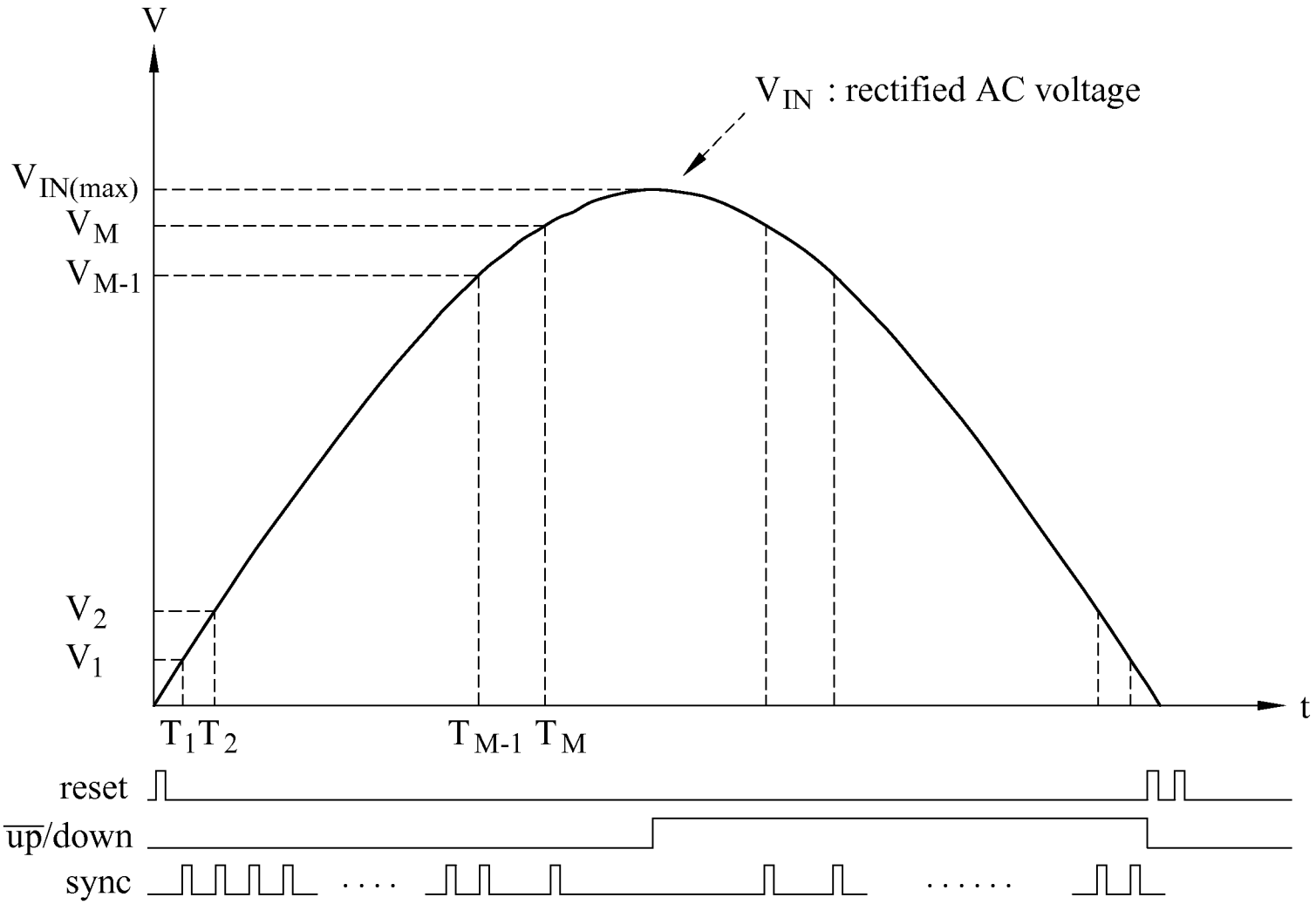
FIG. 3 illustrates the waveforms of the common signals with respect to the input voltage $V_{IN}$ according to the present invention.

The switching voltage comparator unit 301 is responsible for comparing the switching voltage of each operating mode according to the input voltage $V_{IN}$. The switching voltage comparator unit 301 sends a few common signals including reset, up/down and sync signals to each switch controller. The reset signal resets all the switch controllers 201, 202, . . . , 20N to their initial states. Up/down signal indicates the rising or falling of the input voltage $V_{IN}$. Sync signal is a signal for synchronizing the switching of the switch controllers 201, 202, . . . , 20N. FIG. 3 illustrates the waveforms of the common signals with respect to the input voltage $V_{IN}$ which is a rectified AC voltage.

According to the present invention, each switch controller receives an input propagation signal and sends out an output propagation signal to the next switch controller as shown in FIG. 2. As can be seen in FIG. 2, the first switch controller 201 connected in parallel with the first LED-based lighting segment 101 receives a first propagation signal 3011 from the switching voltage comparator unit 301. The propagation signal 2011 is propagated from switch controller 201 to switch controller 202 which again propagates the propagation signal 2021 to the next switch controller. In some applications, there may be no need to control the first LED-based lighting segment 101 on the top. In that case, the switching voltage comparator unit 301 sends the first propagation signal 3011 to the switch controller 202 connected in parallel with the second LED-based lighting segment 102.

It should be noted that in the present invention, each of the switch controllers 201, 202, . . . , 20N is controlled by the switching voltage comparator unit 301 to either put the corresponding LED-based lighting segment connected in series with other LED-based lighting segments or short-circuit the corresponding LED-based lighting segment so that it is bypassed. Each LED-based lighting segment may have different number of LED-based lighting units. The switch controllers 201, 202, . . . , 20N may not be all identical. In addition, current control device 401 shown in FIG. 1 as a current limiting device may be replaced by a resistor 501.

As shown in FIG. 1, the LED-based lighting apparatus of the present invention operates in Mode-i between time $T_i$ and $T_{i+1}$ as the voltage level of the input voltage $V_{IN}$ increases between $V_i$ and $V_{i+1}$. According to the first embodiment shown in FIG. 2, switch controllers 201, 202, . . . , 20N can be controlled by the switching voltage comparator unit 301 to selectively turn on the LED-based lighting units of one or more segments in LED-based lighting segments 101, 102, . . . , 10N.

As an example, during the period between time $T_1$ and $T_2$, switch controller 201 may be controlled by the switching voltage comparator unit 301 to turn on the LED-based lighting units in LED-based lighting segment 101 with all the other segments turned off, and switch controller 202 may be controlled to turn on the LED-based lighting segment 102 during the period between time $T_2$ and $T_3$ with all the other segments turned off. When the input voltage reaches the value between $V_M$ and $V_{IN(Max)}$, all the switch controllers 201, 202, . . . , 20N may be controlled to turn on all the LED-based lighting segments 101, 102, . . . , 10N . . . .

Figure 4:
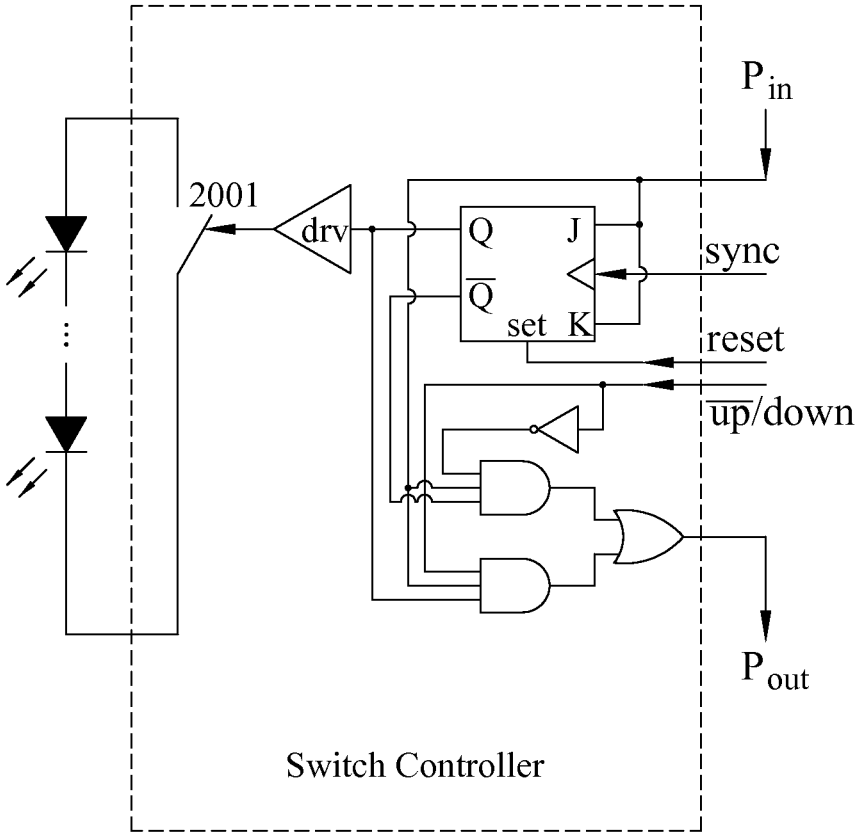
FIG. 4 shows an exemplary circuit for the switch controller according to the first preferred embodiment of the present invention.

FIG. 4 shows an exemplary circuit for the switch controller 201, 202, . . . , 20N according to the first preferred embodiment of the present invention. The switch controller comprises a switching device 2001 connected in parallel with its corresponding LED-based lighting segment. The switch controller receives an input propagation signal $P_{in}$ from the preceding switch controller and sends an output propagation signal $P_{out}$ to the following switch controller. The sync, reset and up/down common signals are sent from the switching voltage comparator unit 301 to the switch controller for the logic circuit in the switch controller to generate the output propagation signal $P_{out}$. A switch control signal is also generated to open or short circuit the switching device 2001.

Figure 5:
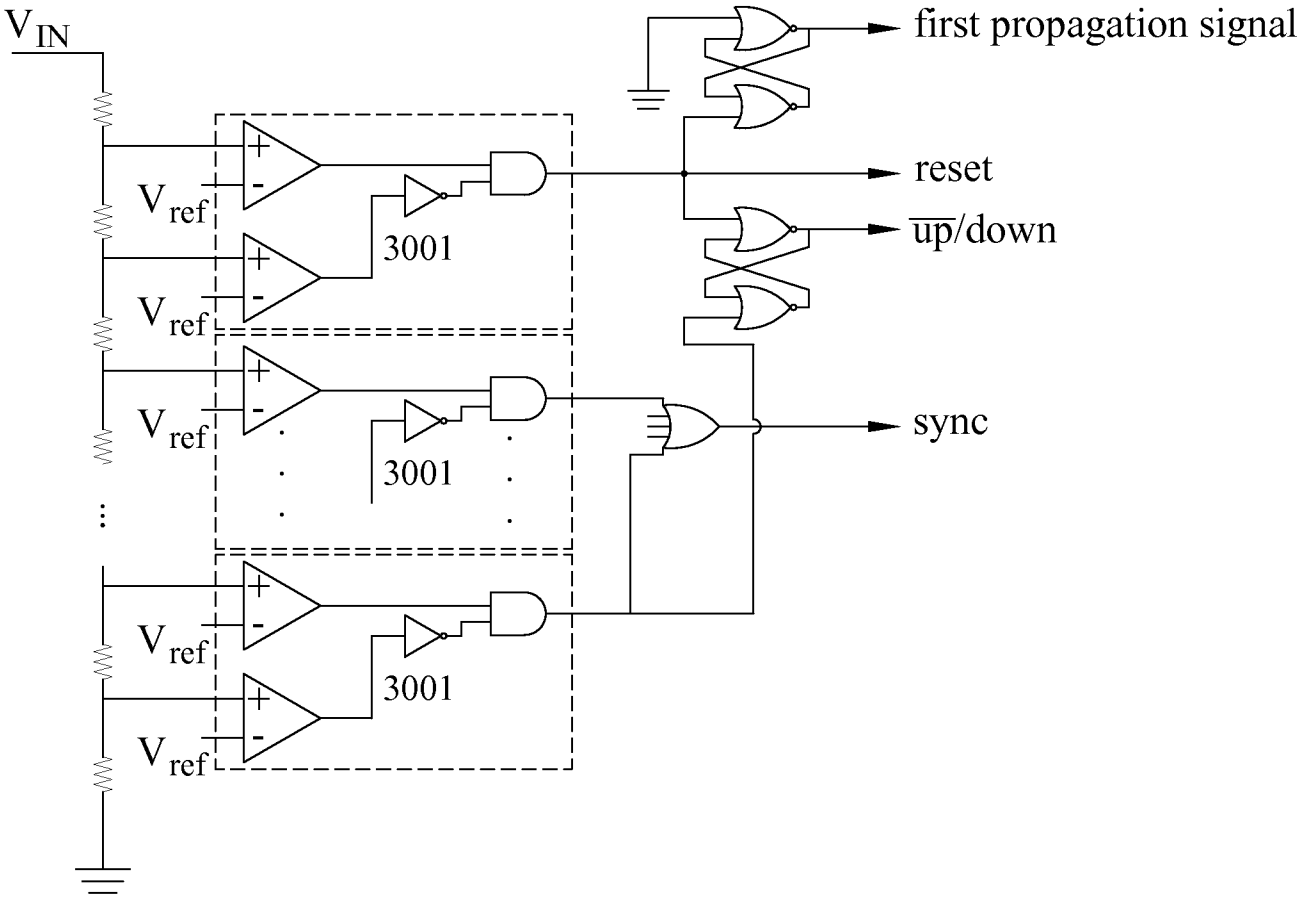
FIG. 5 shows an exemplary circuit for the switching voltage comparator unit according to the first preferred embodiment of the present invention.

FIG. 5 shows an exemplary circuit for the switching voltage comparator unit 301 according to the first preferred embodiment of the present invention. The switching voltage comparator unit 301 comprises a plurality of voltage comparators 3001. According to the voltage level of the input voltage $V_{IN}$, the circuit in the switching voltage comparator unit 301 generates the first propagation signal and the sync, rest and up/down common signals shown in FIG. 3.

Figure 6:
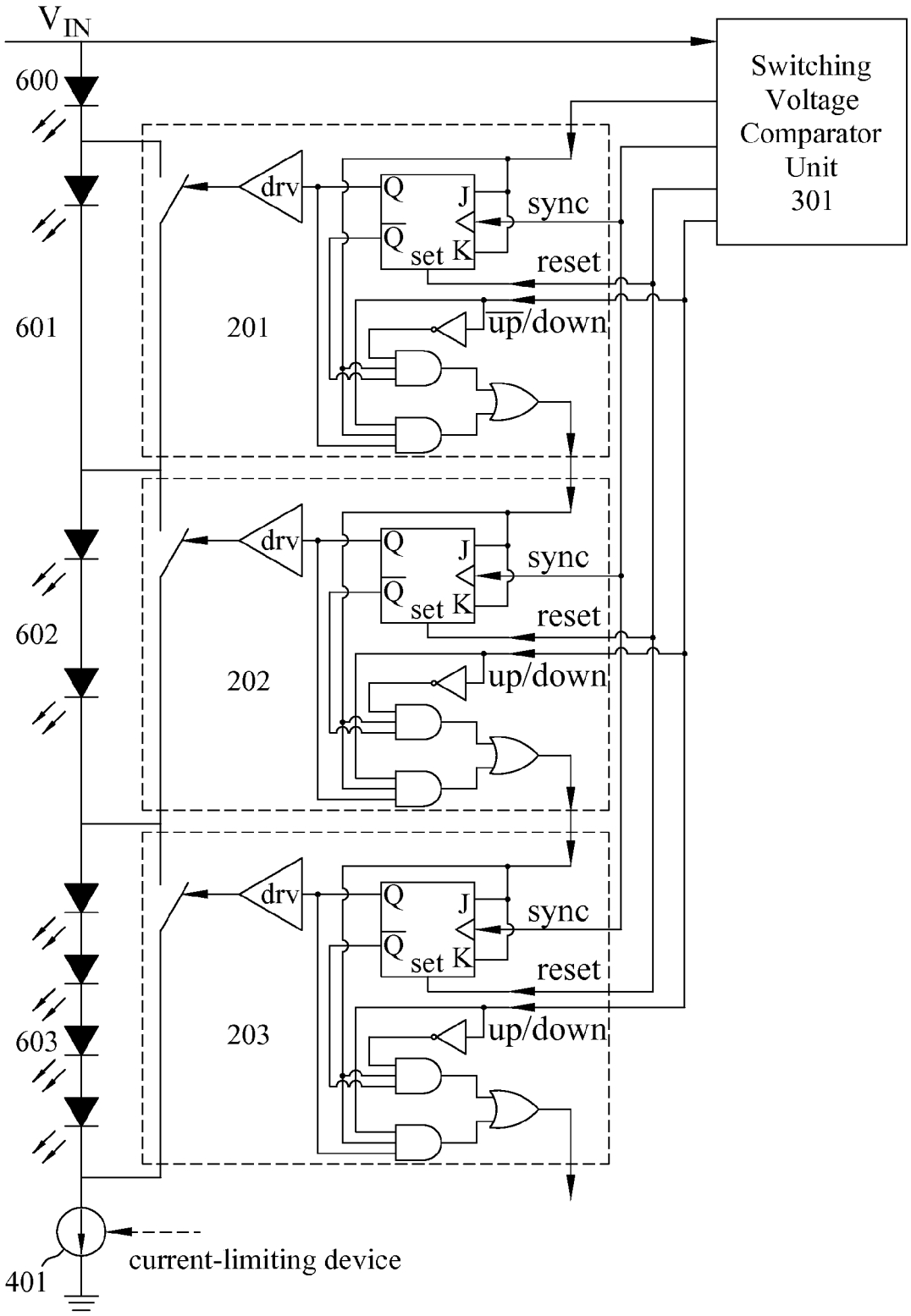
FIG. 6 shows an LED-based lighting apparatus with four LED-based lighting segments controlled by the first preferred embodiment according to the present invention.

FIG. 6 shows an LED-based lighting apparatus with four LED-based lighting segments controlled by the first preferred embodiment according to the present invention. The LED-based lighting segment 600 on the top comprises one LED-based lighting unit and is not controlled by a switch controller. There are one, two and four LED-based lighting units respectively in the other three LED-based lighting segments 601-603 connected in parallel with three switch controllers 201-203. Each LED-based lighting unit is shown to include only one LED. The switching voltage comparator unit 301 sends sync, reset and up/down common signals to each switch controller. The switching voltage comparator unit 301 also sends the first propagation signal to switch controller 201 that then sends an output propagation signal to switch controller 202 that further sends an output propagation signal to switch controller 203.

According to the present invention, the design of the switch controllers determines how some or all of the LED-based lighting segments are turned on or off in different operating modes. With the controller illustrated in FIG. 4, the LED-based lighting apparatus shown in FIG. 6 can be controlled to operate in different modes so that one to eight LEDs can be turned on.

By using the switch controller shown in FIG. 4, the three switch controllers 201-203 in the LED-based lighting apparatus of FIG. 6 form a 3-bit up/down counter to control the switching device 2001 in each switch controller. The propagation signal sent from switching voltage comparator unit 301 controls the up/down counting of the 3-bit counter. When the switch controllers 201-203 are reset, only the LED in segment 600 is turned on because the switching devices 2001 in all the switch controllers 201-203 are shorted.

As the input voltage $V_{IN}$ increases and the propagation signal propagates through the switch controllers 201-203, the 3-bit counter formed by switch controllers 201-203 outputs 011, 101, 001, 110, 010, 100, and 000 in Mode-1, Mode-2, Mode-3, . . . , and Mode-7 to provide different operating modes for the LED-based lighting apparatus to turn on different number of LEDs. For example, in Mode-3, the bits of switch controllers 201 and 202 are 0 because the 3-bit counter value is 001. Therefore, the LEDs in the associated segments 601 and 602 are turned on in addition to the LED in segment 600.

Figure 7:
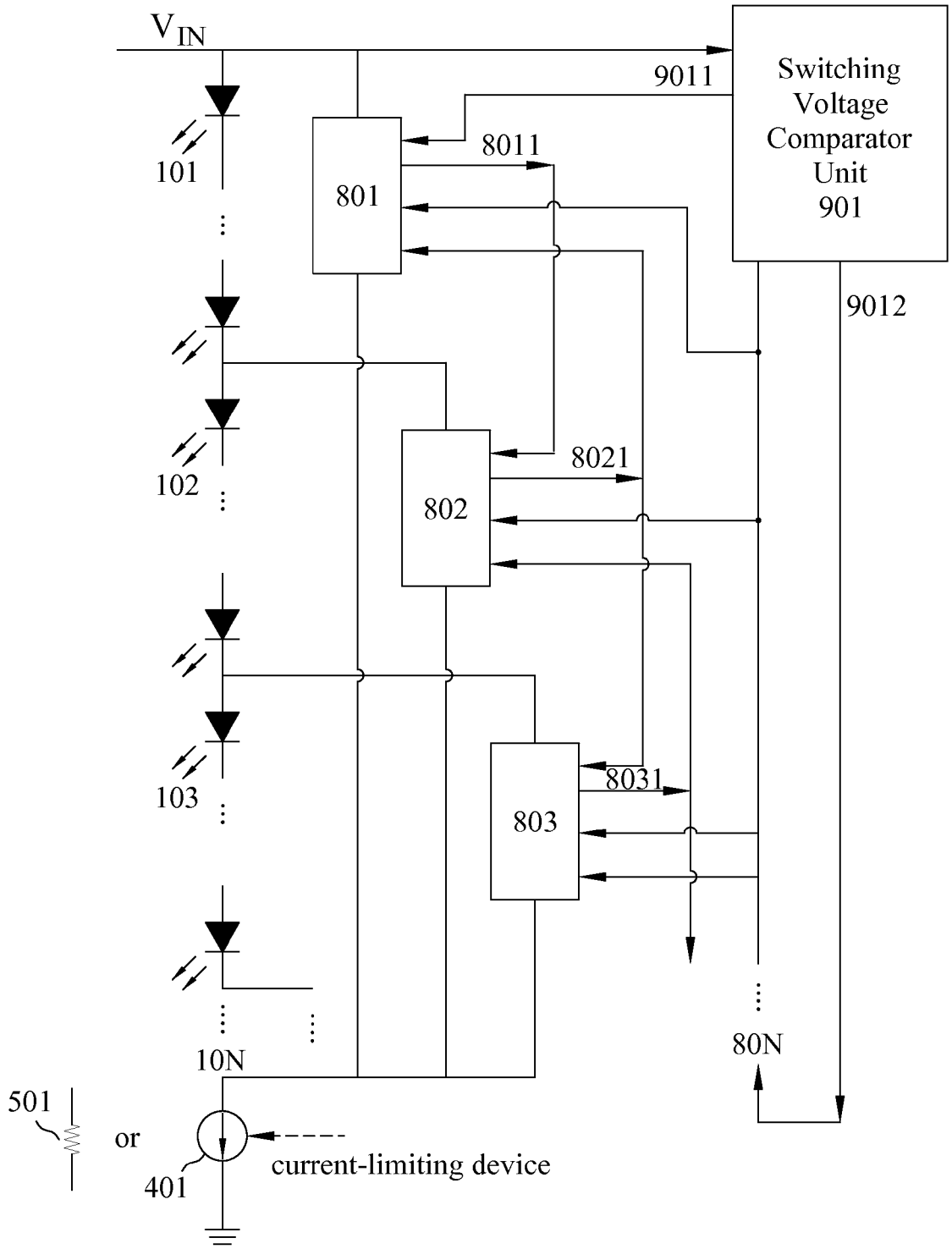
FIG. 7 shows the block diagram of the apparatus for driving a plurality of segments of LED-based lighting units according to a second preferred embodiment of the present invention.

FIG. 7 shows the block diagram of the apparatus for driving a plurality of segments of LED-based lighting units according to a second preferred embodiment of the present invention. In this embodiment, the LED-based lighting apparatus also comprises a plurality of LED-based lighting segments 101, 102, 103, 10N, connected in series with a current control device 401 between an input voltage $V_{IN}$ and ground. Each LED-based lighting segment has a corresponding switch controller that is connected from a positive end of the LED-based lighting segment to a first end of the current control device 401, and a switching voltage comparator unit 901 controls the plurality of switch controllers 801, 802, . . . , 80N.

As can be seen from FIG. 7, a switch controller in this embodiment is connected in parallel with all the LED-based lighting segments below the positive end of the corresponding LED-based lighting segment. For example, switch controller 801 is connected in parallel with the LED-based lighting segments 101-10N, switch controller 802 is connected in parallel with the LED-based lighting segments 102-10N, switch controller 803 is connected in parallel with the LED-based lighting segments 103-10N, . . . , and so on.

Similar to the first embodiment of the present invention, the switching voltage comparator unit 901 is responsible for comparing the switching voltage of each operating mode according to the input voltage $V_{IN}$. The switching voltage comparator unit 901 sends a few common signals including reset, up/down and sync signals to each switch controller. The reset signal resets all the switch controllers 801, 802, . . . , 80N to their initial states. Up/down signal indicates the rising or falling of the input voltage $V_{IN}$. Sync signal is a signal for synchronizing the switching of the switch controllers 801, 802, . . . , 80N.

According to the second embodiment of the present invention, each switch controller sends an output propagation signal to both its preceding and following switch controllers if they exist as shown in FIG. 7. Each switch controller also receives the output propagation signals sent from the preceding and following switch controllers if they are available. For example, switch controller 802 sends output propagation signal 8021 to both switch controller 801 and switch controller 803, and receives output propagation signal 8011 from switch controller 801 and output propagations signal 8031 from switch controller 803.

As can be seen in FIG. 7, the first switch controller 801 receives a first propagation signal 9011 from the switching voltage comparator unit 901 instead of a propagation signal from a preceding switch controller. In this embodiment, the last switch controller 80N receives a last propagation signal 9012 from the switching voltage comparator unit 901 instead of a propagation signal from a following switch controller.

As mentioned before, in some applications, there may be no need to control the first LED-based lighting segment 101 on the top. Under the circumstance, the switching voltage comparator unit 901 sends the first propagation signal 9011 to the switch controller 802 if switch controller 801 does not exist. In addition, each LED-based lighting segment may have different number of LED-based lighting units. Each of the switch controllers 801, 802, . . . , 80N may not be identical to the other switch controllers.

It should be noted that in the second preferred embodiment of the present invention, each of the switch controllers 801, 802, . . . , 80N is controlled by the switching voltage comparator unit 901 to either turn on the corresponding LED-based lighting segments or short-circuit the corresponding LED-based lighting segments so that they are bypassed. For example, if switch controller 801 is controlled to be a short circuit, all the LED-based lighting segments are bypassed, and if switch controller 802 is controlled to be a short circuit, all the LED-based lighting segments except the first LED-based lighting segment 101 are bypassed, . . . , and so on.

The operation in the second embodiment of the present invention also operates in Mode-i between time $T_i$ and $T_{i+1}$ as the voltage level of the input voltage $V_{IN}$ increases between $V_i$ and $V_{i+1}$ as shown in FIG. 1. According to the second embodiment shown in FIG. 7, during the period between time $T_1$ and $T_2$, only switch controller 801 is controlled by the switching voltage comparator unit 901 to turn on the LED-based lighting units in LED-based lighting segment 101 and all the other LED-based lighting segments 102, 103, . . . , 10N are short-circuited by their corresponding switch controllers 802, 803, . . . , 80N.

During the period between time $T_2$ and $T_3$, both switch controllers 801 and 802 are controlled by the switching voltage comparator unit 901 to turn on the LED-based lighting units in LED-based lighting segments 101, 102 and the other LED-based lighting segments 103, . . . , 10N are short-circuited by their corresponding switch controllers 803, . . . , 80N.

Similar to the first embodiment, the LED-based lighting segments as shown in FIG. 7 are turned on sequentially from segment 101, segment 102, . . . , to segment 10N when the voltage level of the input voltage $V_{IN}$ increases from 0 to the maximum voltage level $V_{IN(max)}$. When the voltage level of the input voltage $V_{IN}$ reaches the maximum level and starts decreasing, the LED-based lighting segments are turned off sequentially.

Figure 8:
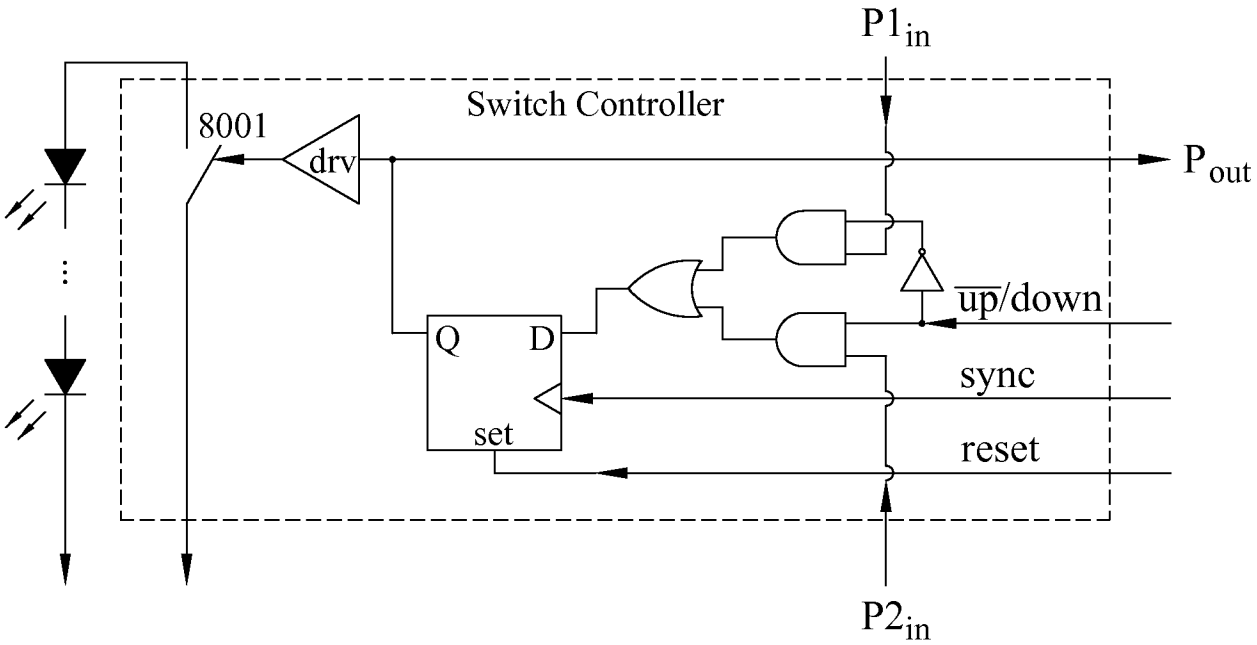
FIG. 8 shows an exemplary circuit for the switch controller according to the second preferred embodiment of the present invention.

FIG. 8 shows an exemplary circuit for the switch controller 801, 802, . . . , 80N. The switch controller comprises a switching device 8001 connected in parallel with its corresponding LED-based lighting segments. The switch controller receives a first input propagation signal $P1_{in}$ from the preceding switch controller and a second input propagation signal $P2_{in}$ from the following switch controller, and sends an output propagation signal $P_{out}$ to both preceding and following switch controllers. The sync, reset and up/down common signals are sent from the switching voltage comparator unit 901 to the switch controller for the logic circuit in the switch controller to generate the output propagation signal $P_{out}$. A switch control signal is also generated to open or short circuit the switching device 8001.

Figure 9:
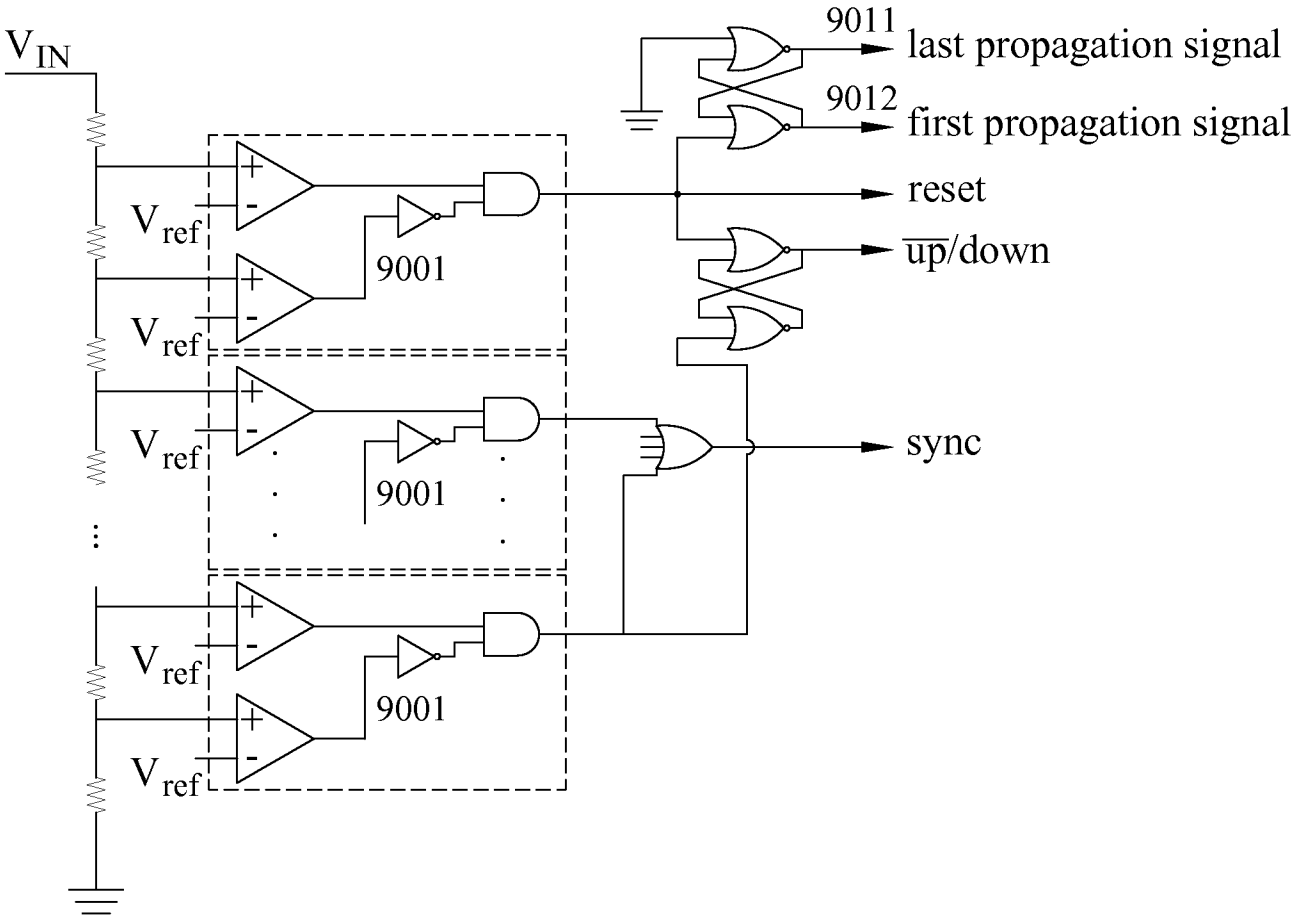
FIG. 9 shows an exemplary circuit for the switching voltage comparator unit according to the second preferred embodiment of the present invention.

FIG. 9 shows an exemplary circuit for the switching voltage comparator unit 901 of the second embodiment according to the present invention. The switching voltage comparator unit 901 comprises a plurality of voltage comparators 9001. According to the voltage level of the input voltage $V_{IN}$, the circuit in the switching voltage comparator unit 901 generates the sync, rest and up/down common signals. In addition, the first and last propagation signals 9011, 9012 are also generated from the switching voltage comparator unit 901 for the first and last switch controller 801, 80N shown in FIG. 7.

Figure 10:
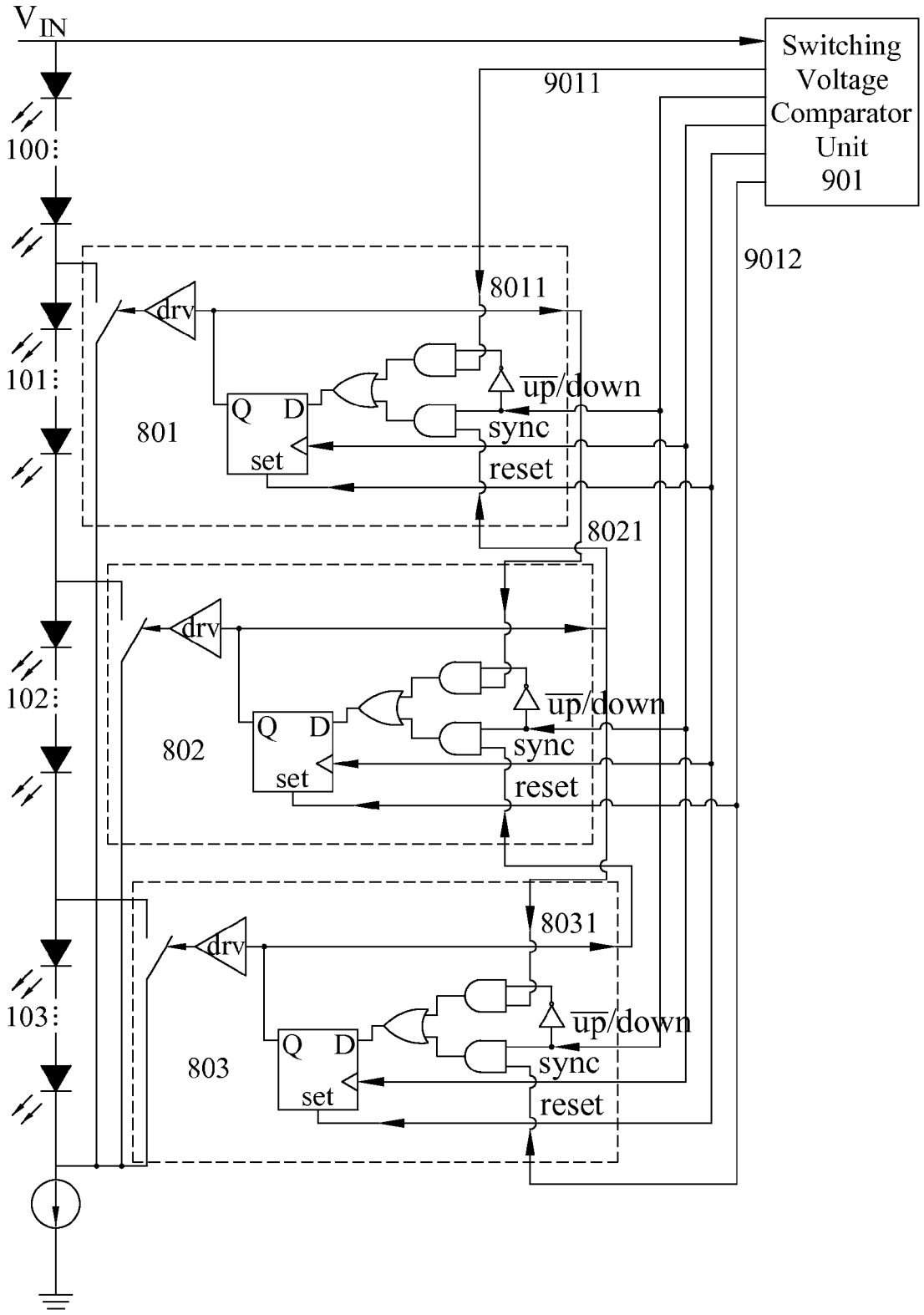
FIG. 10 shows an LED-based lighting apparatus with four LED-based lighting segments controlled by the second preferred embodiment according to the present invention.

FIG. 10 shows an LED-based lighting apparatus with four LED-based lighting segments controlled by the second preferred embodiment according to the present invention. The LED-based lighting segment 100 on the top is not controlled by a switch controller. Three switch controllers 801-803 are respectively connected between the positive ends of the other three LED-based lighting segments 101-103 and the first end of the current control device 401.

The switching voltage comparator unit 901 sends sync, reset and up/down common signals to each switch controller. The switching voltage comparator unit 901 further sends the first propagation signal 9011 to switch controller 801 and the last propagation signal 9012 to switch controller 803. Switch controller 801 sends a propagation signal 8011 to switch controller 802 that sends a propagation signal 8021 to both switch controller 801 and switch controller 803. Switch controller 803 also sends a propagation signal 8031 to switch controller 802.

Figure 11:
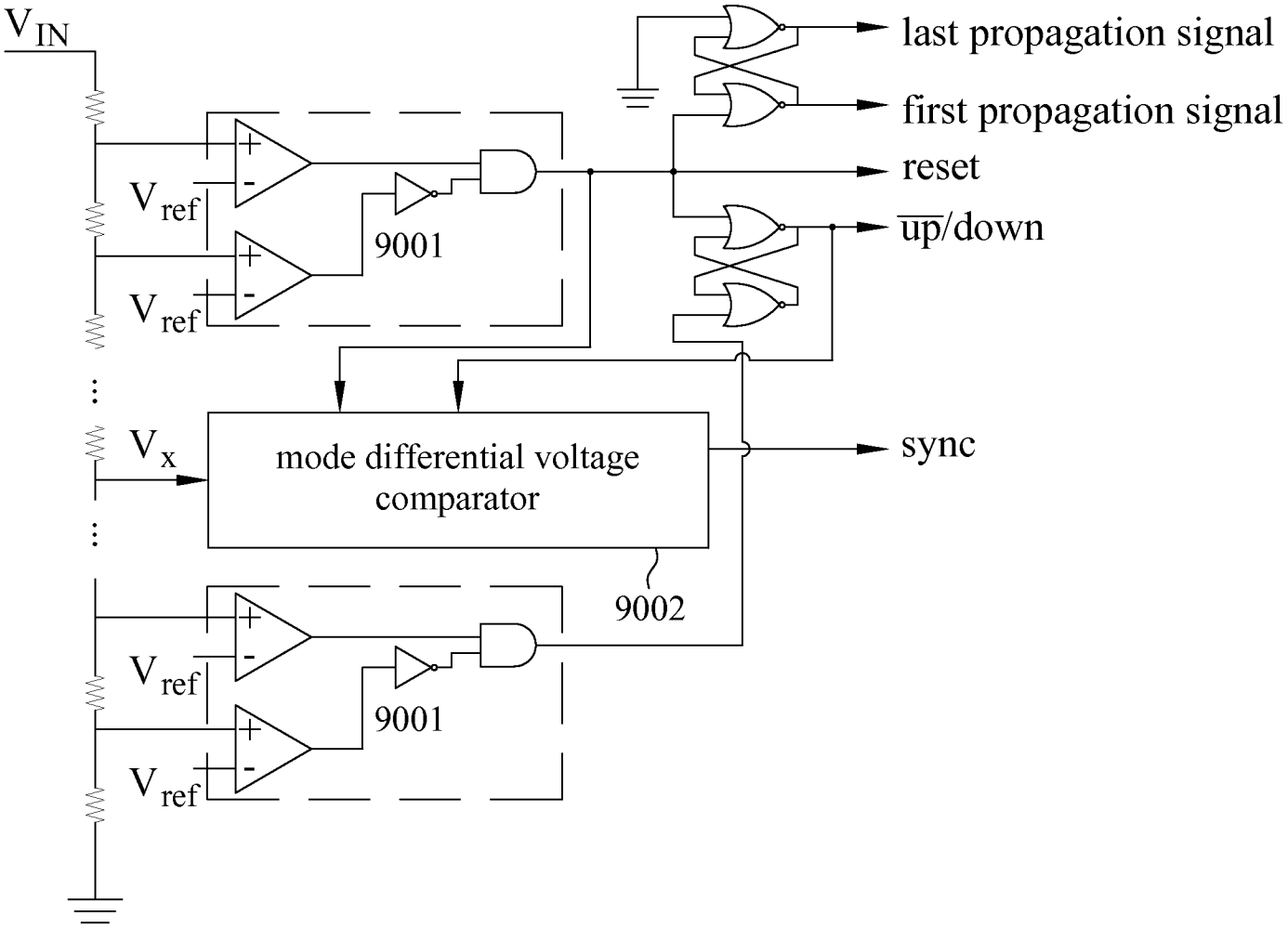
FIG. 11 shows another exemplary circuit for the switching voltage comparator unit according to the second preferred embodiment of the present invention.

In accordance with the second embodiment of the present invention, the switching voltage comparator unit 901 can also be realized by the exemplary circuit shown in FIG. 11. In this circuit, the switching voltage comparator unit 901 comprises a mode differential voltage comparator 9002 in addition to two voltage comparators 9001. The mode differential voltage comparator 9002 is used to generate the sync signal from the common signals reset and up/down as shown in FIG. 12 instead of deriving the sync signal from the output of a plurality of voltage comparators 9001 as shown in FIG. 9.

Figure 12:
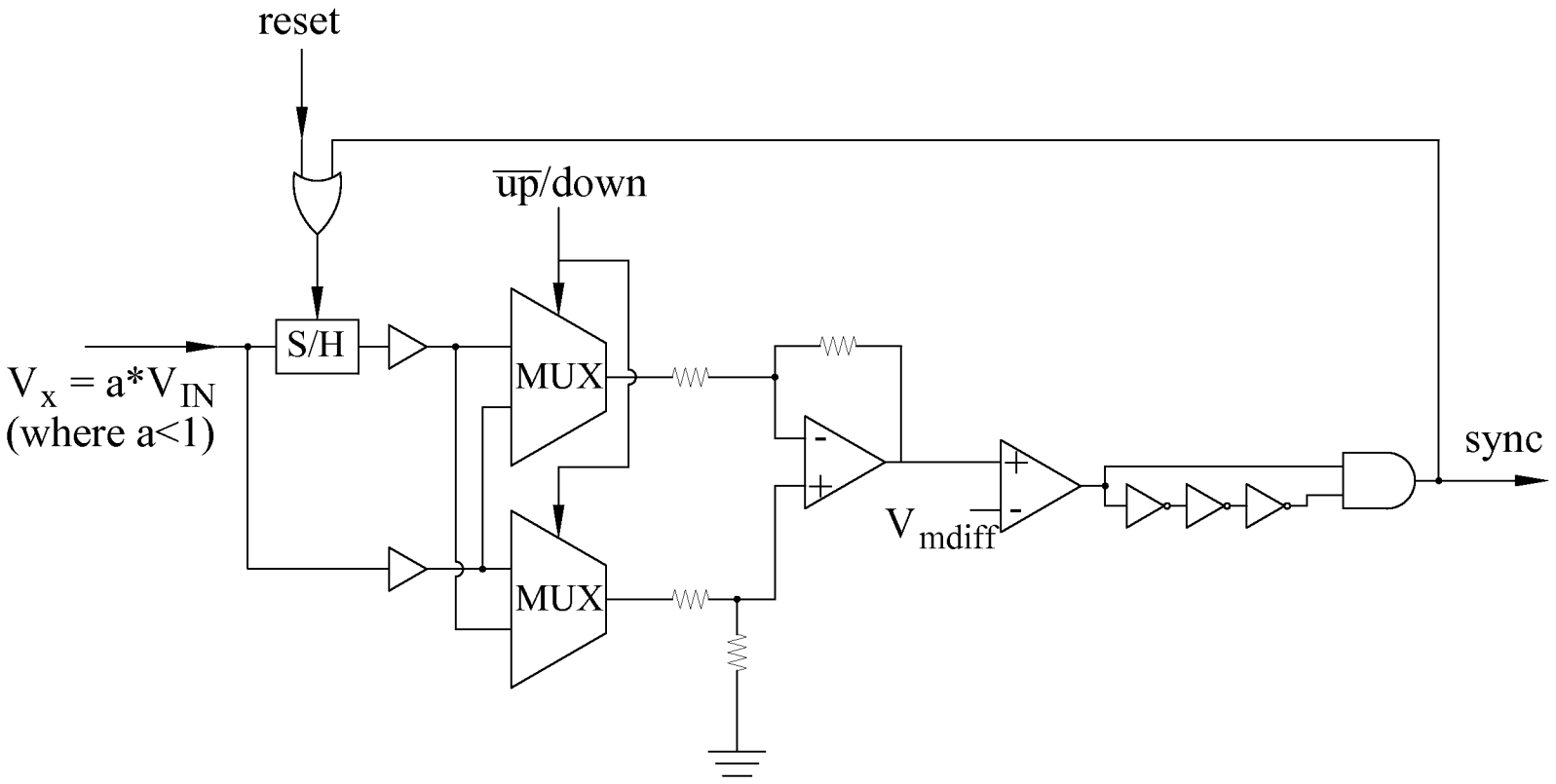
FIG. 12 shows the detailed circuit of the mode differential voltage comparator in the switching voltage comparator unit shown in FIG. 11.

FIG. 12 shows the detailed circuit of the mode differential voltage comparator 9002 of FIG. 11. In addition to the common signals reset and up/down, a voltage level $V_X=\alpha*V_N$ derived from the input voltage $V_{IN}$ serves as the input to the mode differential voltage comparator 9002, where a is a scaling factor less than 1.

According to the present invention, the LEDs in the LED-based lighting unit refer to all types of light emitting diodes such as semi-conductor and organic light emitting diodes that may emit light at various frequency spectrums. The apparatus may comprise any number of LED-based lighting units and each LED-based lighting unit may comprise any number of LED devices according to the requirements in the specific application of the apparatus.

The exemplary circuits shown for the switch controllers and the switching voltage comparator unit are given to explain the principles of the present invention. Both switch controllers and switching voltage comparator unit can be designed with other equivalent circuits that can achieve the same functions. The switching device in the switch controller refers generally to a switching device with appropriate controlling mechanism for opening or closing the connection or a circuit. The switching device may be mechanical or electrical, or a semiconductor switch implemented with integrated circuits.

In summary, the present invention provides an apparatus for driving an LED-based lighting apparatus by dividing a plurality of LED-based lighting units into a plurality of LED-based lighting segments controlled by a plurality of switch controller. Multiple operation modes for the lighting apparatus are achieved by using a switching voltage comparator unit to send a few common signals to each switch controller and generate one or two propagation signals that through the switch controllers to either short-circuit or turn on the corresponding LED-based lighting segment.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An apparatus for driving a plurality of LED-based lighting units, comprising:

a plurality of LED-based lighting segments connected in series, each of said LED-based lighting segments having a positive end and a negative end, and including at least one LED-based lighting unit connected in series;

an input voltage supply coupled to the positive end of a first segment of said LED-based lighting segments;

a current control device having a first end connected to the negative end of a last segment of said LED-based lighting segments and a second end connected to ground;

a plurality of switch controllers, each of said switch controllers being connected in parallel with one corresponding segment of said LED-based lighting segments, each of said switch controllers receiving an input propagation signal and generating an output propagation signal;

a switching voltage comparator unit receiving said input voltage supply, generating and sending a plurality of common signals to each of said plurality of switch controllers, and generating a first propagation signal as the input propagation signal of a first switch controller of said plurality of switch controllers;

wherein the input propagation signal of each switch controller except for the first switch controller is the output propagation signal of an immediately preceding switch controller, each switch controller includes a switching device for short-circuiting the corresponding LED-based lighting segment, said switching device is controlled according to the input propagation signal of the switch controller, and the output propagation signal of each switch controller is derived from the input propagation signal of the switch controller and said common signals.

2. The apparatus as claimed in claim 1, wherein said each switch controller comprises one bit of a multi-bit counter formed by said plurality of switch controllers to control said switching device according to said input propagation signal of the switch controller.

3. The apparatus as claimed in claim 1, wherein said common signals includes a reset signal for resetting said switch controllers, a sync signal for synchronizing switching of said switch controllers, and an up/down signal for signaling whether said input voltage supply has an increasing or decreasing voltage level.

4. The apparatus as claimed in claim 1, wherein said switching voltage comparator unit comprises a plurality of voltage comparators for generating said common signals and said first propagation signal based on a voltage level of said input voltage supply.

5. The apparatus as claimed in claim 1, wherein at least one segment of said LED-based lighting segments is not connected in parallel with a switch controller.

6. The apparatus as claimed in claim 1, wherein at least one segment of said LED-based lighting segments has a different number of LED-based lighting units.

7. The apparatus as claimed in claim 1, wherein at least one of said switch controllers has a circuit different from other switch controllers.

8. The apparatus as claimed in claim 1, wherein said current control device is a current limiting device.

9. The apparatus as claimed in claim 1, wherein said current control device is a resistor.

10. The apparatus as claimed in claim 1, wherein said plurality of LED-based lighting segments comprise a first segment, a second segment, a third segment, and a fourth segment, and said plurality of switch controllers comprise three switch controllers respectively connected in parallel with said second, third and fourth segments.

11. The apparatus as claimed in claim 10, wherein said plurality of switch controllers form a 3-bit counter with each switch controller comprising a single bit of said 3-bit counter, and each switch controller has a switching device controlled by the corresponding single bit to either short-circuit the corresponding segment in said plurality of LED-based lighting segments or connect the corresponding segment in series with other segments.

12. The apparatus as claimed in claim 11, wherein said first segment comprises one LED-based lighting unit, said second segment comprises one LED-based lighting unit, said third segment comprises two LED-based lighting units, and said fourth segment comprises four LED-based lighting units.

13. The apparatus as claimed in claim 12, wherein said plurality of switch controllers are controlled by said switching voltage comparator unit to provide multiple operating modes for turning on one to eight LED-based lighting units in said apparatus.

* * * * *